United States Patent [19]

Littler

[11] 4,274,161

[45] Jun. 23, 1981

[54] CRASH HELMET COLLAR

[76] Inventor: Brian J. Littler, Frankfurter Strasse 84, D-6051 Nieder-Roden, Fed. Rep. of Germany

[21] Appl. No.: 853,525

[22] Filed: Nov. 21, 1977

[30] Foreign Application Priority Data

Nov. 29, 1976 [DE] Fed. Rep. of Germany ..... 2654051

[51] Int. Cl.[3] ..... A42B 3/02; A41B 3/00

[52] U.S. Cl. ..... 2/413; 2/415

[58] Field of Search ..... 2/413, 415, 2, 2.5

[56] References Cited

U.S. PATENT DOCUMENTS

| | | | |
|---|---|---|---|
| 3,320,619 | 5/1967 | Lastnik et al. | 2/2.5 X |
| 3,591,863 | 7/1971 | Rickard | 2/415 |
| 3,855,631 | 12/1974 | Ettinger | 2/2 |
| 4,038,700 | 8/1977 | Györy | 2/413 |
| 4,094,015 | 6/1978 | Howard | 2/415 |

*Primary Examiner*—Peter P. Nerbun

*Attorney, Agent, or Firm*—McAulay, Fields, Fisher, Goldstein & Nissen

[57] ABSTRACT

There is provided a collar for protection in an accident, the collar being in the form of an inflatable tubular body adapted to substantially surround a human neck. The collar is particularly suitable for use by a motor cyclist wearing a crash helmet.

17 Claims, 2 Drawing Figures

CRASH HELMET COLLAR

FIELD OF THE INVENTION

The invention relates to the protection of persons wearing crash helmets, in particular motor cyclists, in the event of an accident, for example a collision with a travelling vehicle.

BACKGROUND OF THE INVENTION

In accidents involving motor cyclists wearing a crash helmet there is a danger of injuries in the region of the cervical vertebrae if the head is thrust backwards, as well as in the region of the breast bone or collar bone if the head is wrenched forward or side-ways. For example, when the head is turned upwardly and rearwardly the portion of the spine formed by the cervical vertebrae bows rearwardly. At the limit of this bowing movement the vertebrae stop and lock and forces applied to the head are exerted on the vertebrae. If these are too great the vertebrae are displaced or damaged causing injuries which may be serious and even death. Furthermore, there is a danger of the lower rim of the rear of the helmet being forced against the back of the neck. For this reason, a number of crash helmets have an area cut out at the nape of the neck so as to prevent the rear lower rim of the helmet from acting on the region of the cervical vertebrae. The freedom of the head to move backwards is increased by this measure, so that particularly in the event of a crash at high speed, the head with the helmet is displaced backwards. In this case, the risk of the cervical portion of the spine being bowed excessively and of the cervical vertebrae from being separated and breaking, causing damage to the spinal cord, is increased.

Various proposals have been made for reducing these dangers, for example the use of a neck-engaging pad, but no adequate solution has hitherto been found.

SUMMARY OF THE INVENTION

According to the invention there is provided a collar for protection in an accident, the collar being in the form of an inflatable tubular body adapted to substantially surround a human neck.

A collar formed in this way holds the head with respect to the neck and trunk by a shock-absorbing support, and in addition provides direct protection for the neck. The dangerous abrupt jerking movements are substantially avoided. The collar, which is preferably filled with air, is in contact with the underside or lower rim of the helmet in the manner of an air cushion and so restricts the movement of the head in any direction in a progressive manner. This makes it possible for the user to wear a larger and/or heavier helmet, since the collar enables the user to withstand greater force arising from the weight of the helmet and the force arising from the wind resistance of the helmet. This in turn makes it possible to provide a helmet which contains a greater amount of shock-absorbing material.

The inflatable collar may be joined to a crash helmet provided with an inflatable lining or padding. In this case, it is advantageous for the interior of the collar to communicate directly with the interior of the lining of the crash helmet, for example by means of an insertable connecting piece. It is thus possible for the helmet to sit firmly but sufficiently flexibly on the surface of the head after putting on the collar and the helmet.

The collar may be connected directly with the crash helmet, for example with the lining thereof. This allows the helmet and collar to be put on simply and correctly. Alternatively the collar may be connected to a garment such as a jacket worn by a motor cyclist. In this case it may be unnecessary to provide any means for fastening the ends of the collar together, since if the jacket has a fastener, for example a zipper, the ends of the collar will be brought together automatically when the jacket fastener is done up. The collar may of course be attached neither to the helmet nor to a garment.

In its deflated state the collar according to the invention needs little room for storage and, where not attached to a garment, may be placed in the interior of the helmet when not in use. The collar is suitable for use both with conventional helmets and with helmets having inflatable linings.

DESCRIPTION OF PREFERRED EMBODIMENT

Figure 1:
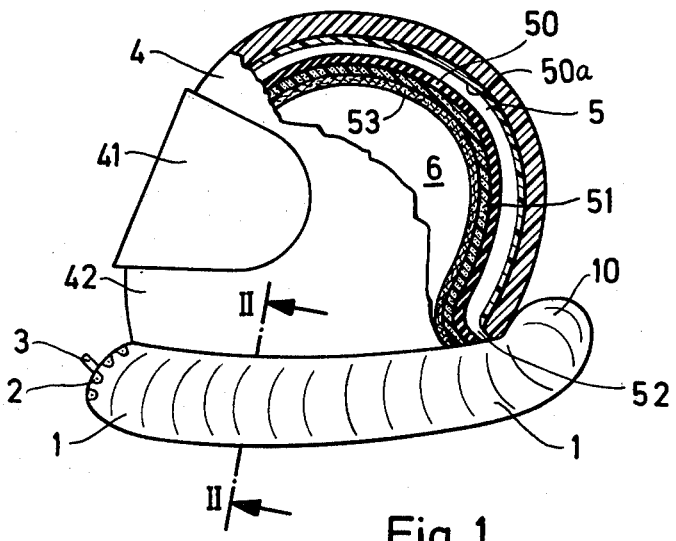
FIG. 1 is a partially cut away side view of a crash helmet having an integral mouth and chin protector, with an associated collar for protection in the event of an accident, in the inflated state.

FIG. 1 shows a crash helmet 4 with a visor 41 and a mouth and chin protector 42. The crash helmet 4 has an inflatable lining chamber 5 formed by air-tight layers 50 and 50*a*. Over the air-tight layer 50 is a layer 51 with high resistance to penetration and a layer 53 composed mainly of cotton for direct contact with the surface 6 of the head of the person wearing the helmet 4. The layer 51 is preferably a felt such as an "Aramid" felt. "Aramid" is a polyamide product marketed by E. I. du Pont de Nemours & Co. Inc. and used in several layers under the trade name "Kevlar" as a fabric for bullet-proof waistcoats. If desired the felt may be impregnated with a resin to render it rigid.

A collar 1 is arranged on the underside of the helmet 4 and is in the form of an elongated tubular body shaped to surround the neck and with its ends joined together by a button fastener 2 at the front. Instead of a button fastener any other suitable fastener could be used, for example one in which pieces of material provided with a large number of hooks and eyes are secured to the end regions of the collar, the hooks and eyes being interengageable with one another. Suitable material is sold under the Trade Mark "Velcro". By making the pieces sufficiently large the collar can be adapted to fit a large range of neck sizes. A bulging rim 10 points upwards in the region of the nape of the neck. The rim 10 improves the cushioning effect when the head is thrust backwards. The cross-section of the collar preferably increases from the front to the nape area, when viewed from the side. At least one sealable opening serves for filling the hollow tubular body with air and for emptying it of air. A valve tube 3 which may be sealed, for example, by a check valve, is provided at the front. The collar 1 may be inflated using this valve tube 3 as a mouthpiece. Air blown in through the valve tube may be blown through an air passage 52 between the collar 1 and the inflatable lining chamber 5 of the helmet and thus through the collar 1 into the lining chamber 5 which may be constructed of several interconnected inflatable divisions.

Figure 2:
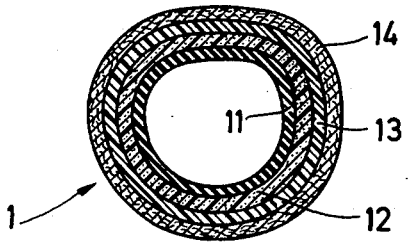
FIG. 2 is a cross-sectional along line II—II through the collar of FIG. 1 on an enlarged scale.

FIG. 2 shows how the wall of the tubular body of the collar 1 is composed of several layers. When considered from the interior outwards, the wall in this specific embodiment consists of the following layers: a layer 11 of air-tight material, a layer 12 of a felt having a high resistance to penetration, a layer 13 of a material having a high resistance to abrasion and great strength, and a layer 14 which is suitable for direct contact with the surface of the neck. The use of such a layer 12 greatly reduces the risk of damage to the layer 11 by sharp projections on a motor cycle or on objects in the region of an accident, for example kerb stones and road barriers. The layer 13 serves to reduce the risk of damage to the collar from, for example, abrasion on contact with the road surface. The layer 14 is preferably readily removable to enable it to be cleaned or replaced when it is worn or torn. A fabric formed from a polytetrafluorethylene (PTFE) multifilament yarn or a fabric formed from a yarn having a mixture of PTFE and polyamide threads is preferably used for the layer 13, this being a fabric having not only high strength but also a high resistance to abrasion. A cotton fabric or a fabric composed of 90% cotton is preferably used for the layer 14. The above-mentioned "Aramid" felt is preferably used for the layer 12.

In an alternative embodiment the layers 12,13 and 14 are replaced by a single layer of leather, preferably kangaroo leather.

I claim:

1. A collar device for use with a protective helmet having a bottom edge for the protection of a motorcyclist in an accident, comprising:

an elongated inflatable tubular body adapted to substantially surround a motorcyclist's neck, said body being sized and positioned, when inflated to be in contact substantially with the entire lower edge rim of the helmet and the upper trunk of the motorcyclist's body, to transmit to, and cushion against, the motorcyclist's body, forces generated at the helmet, thereby to protect the neck;

securing means operable in a closed mode for securing the ends of the collar in adjacent relationship to close the collar around the neck; and in an open mode to release the ends for removal of said collar from the neck.

2. A device according to claim 1, wherein the tubular body has a bulging rim in the region of the nape of the neck.

3. A device according to claim 1, wherein the securing means is a fastener provided on the collar.

4. A device according to claim 1, wherein the tubular body is inflatable via a check valve.

5. A device according to claim 4, wherein the valve is in communication with a tube extending from the collar.

6. A device according to claim 1, wherein the wall of the tubular body is composed of a plurality of layers.

7. A device according to claim 6, wherein the said wall comprises a layer of a felt having a high resistance to penetration surrounding an air-tight inner layer.

8. A device according to claim 6, wherein the said wall has an external layer composed of a material comprising polytetrafluorethylene.

9. A device according to claim 8, wherein the said external layer is composed of a fabric formed of a polytetrafluorethylene multifiliament yarn.

10. A device according to claim 8, wherein the said external layer is composed of a fabric formed from a polytetrafluorethylene polyamide blended yarn.

11. A device according to claim 1, wherein the tubular body is provided with a detachable outer layer.

12. A device according to claim 11, wherein the said outer layer is composed of a cotton fabric.

13. A device according to claim 1, wherein the collar communicates with an inflatable lining of a crash helmet.

14. A device according to claim 13, wherein a layer composed of a felt having a high resistance to penetration is joined to the inflatable lining on the side thereof nearer the surface of the head to be received.

15. A device according to claim 14, wherein a layer composed of a cotton fabric is joined to the felt layer.

16. A device according to claim 1, wherein the collar is fixed to a garment for wearing by a motor cyclist.

17. A device according to claim 1, wherein the collar is fixed to a crash helmet.

* * * * *